United States Patent [19]

Kleyn

[11] Patent Number: 4,782,630

[45] Date of Patent: Nov. 8, 1988

[54] CLOSURE FRAME ASSEMBLIES

[76] Inventor: Robert J. Kleyn, 95 Kommissaris Street, Welgemoed, 7530, South Africa

[21] Appl. No.: 89,077

[22] Filed: Aug. 25, 1987

[30] Foreign Application Priority Data

Aug. 25, 1986 [ZA] South Africa ..... 86/6405

[51] Int. Cl.[4] ..... B06B 1/04

[52] U.S. Cl. ..... 49/505; 52/217

[58] Field of Search ..... 49/505, 504, DIG. 2; 52/217

[56] References Cited

U.S. PATENT DOCUMENTS

| | | | |
|---|---|---|---|
| 908,858 | 1/1909 | Goddard | 49/505 |
| 3,553,891 | 1/1971 | Casebolt et al. | 52/217 |

FOREIGN PATENT DOCUMENTS

| | | | |
|---|---|---|---|
| 1759190 | 7/1971 | Fed. Rep. of Germany | 52/217 |
| 7709349 | 2/1979 | Netherlands | 49/505 |
| 408375 | 6/1964 | Switzerland | 49/505 |

*Primary Examiner*—Kenneth J. Dorner
*Assistant Examiner*—Gerald A. Anderson
*Attorney, Agent, or Firm*—Larson and Taylor

[57] ABSTRACT

A removable type of closure frame assembly, such as a window or door frame, is provided. It includes an outer circumferential part adapted to receive a panel member such as a window pane and is adapted to abut on the outer surface of a wall surrounding an aperture. A jaw component is associated with the outer circumferential part and has an elongated recess. A first locking formation is provided inside the elongated recess. An inner circumferential part is adapted to abut on the inner surface of a wall surrounding an aperture. A tongue component is associated with the inner circumferential part. A second locking formation is provided at an extremity of the tongue component. The first and second locking formations are adatped to lock together. A removable locking member is adapted to be inserted into the recess for pressing the first and second locking formations firmly into locking contact.

7 Claims, 6 Drawing Sheets

CLOSURE FRAME ASSEMBLIES

FIELD OF INVENTION

The present invention relates to closure frame assemblies.

More particularly, the invention relates to closure frame assemblies to be used as window frames or door frames.

BACKGROUND TO INVENTION

Frames for closures, such as window frames, which are constructed of extruded sections, normally are embedded in or screwed to the parts of a wall surrounding an aperture. The disadvantage of such frames is that they are generally of complicated construction, and cannot be removed easily if required.

It is an object of the invention to provide a closure frame assembly, which can be pre-manufactured almost fully and can be attached removably to a wall.

SUMMARY OF INVENTION

According to the invention, a closure frame assembly, includes an outer circumferential part adapted to receive a panel member and having first abutment means adapted to abut on the outer surface of a wall surrounding an aperture; a jaw component associated with the outer circumferential part and having an elongated recess; a first locking formation provided inside the elongated recess; an inner circumferential part having second abutment means adapted to abut on the inner surface of a wall surrounding an aperture in a wall; a tongue component associated with the inner circumferential part and extending therefrom; a second locking formation provided at an extremity of the tongue component and being spaced away from the second abutment means, the first and second locking formations being adapted to lock together when the second locking formation is located in the elongated recess of the jaw component and is pressed against the first locking formation; and a removable locking member adapted to be inserted into the recess for pressing the first and second locking formations firmly into locking contact.

The outer circumferential part may comprise four individual elongated members joined together to form a rectangular outer frame.

The inner circumferential part may include a number of individual elongated members, one of which constitutes an inner sill of a window frame.

The first locking formation may include teeth formations in the elongated recess, and the second locking formation may include associated teeth formations at the tongue component's extremity.

The locking member may be a resilient elongated locking strip adapted to be fitted into the elongated recess for pressing the extremity of the tongue component towards the first locking formation in the elongated recess. The strip may be a continuous strip or may be provided in sections.

The assembly may be a window frame assembly, or a door frame assembly.

BRIEF DESCRIPTION OF DRAWINGS

The invention will now be described by way of example with reference to the accompanying schematic drawings.

In the drawings there is shown in

DETAILED DESCRIPTION OF DRAWINGS

Figure 1:
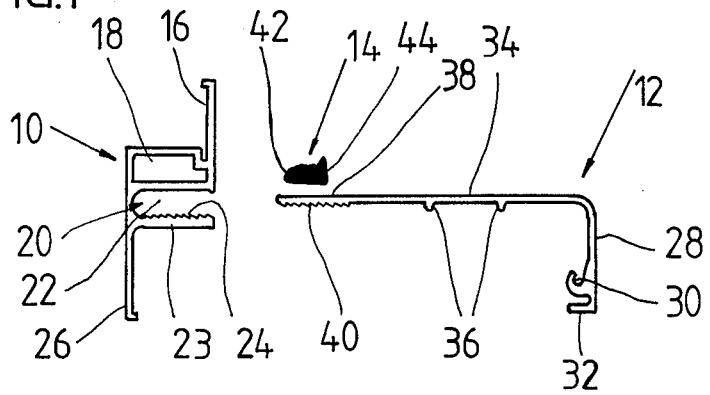
FIG. 1 a schematic side view of the components of a window frame structure in accordance with the invention, the components being shown prior to fitting when completely separated.

Referring to FIGS. 1 to 4, the components of a window frame assembly in accordance with the invention basically include an outer circumferential part 10, such as an aluminium extrusion, an inner circumferential part 12, also made of an aluminium extrusion, and a plastics locking strip 14.

It must be noted that in a frame assembly built up of components in accordance with the invention, the outer circumferential part and the associated inner circumferential part will be the same for the horizontal head part, the two vertical parts and the horizontal bottom part of a rectangular shaped frame.

Accordingly, although the drawings generally only show the components of the bottom part of the frame, it must be understood that the drawings and description similarly are applicable to the head or top and side parts. When referring to similar parts therefore the suffix .1, .2 and .3 will be added to refer respectively to the two vertical components and the horizontal head components, e.g. 12.1, 12.2, 12.3, whereas the bottom component has no suffix, e.g. 12.

The outer part 10 has a flange 16, a cleat recess 18, an elongated jaw 20 with a recess 22, on the one side of which a leg 23 with teeth or serrations 24 is provided. The part 10 further has a flange 26.

The inner part 12 has a flange 28 with a screw groove 30 for receiving screws and a spacer end 32 at its extremity. It further has a web 34 provided with stiffeners 36 at its underside, which stiffeners also act as stops for preventing bending as will be explained hereafter. At the extremity of the leg 34 is tongue 38 with teeth or serrations 40 is provided.

The sealing strip 14 is wedge-shaped with a front pointed end 42 and a broad rear or base end 44.

FIG. 1 shows the component in completely disassembled condition.

Figure 2:
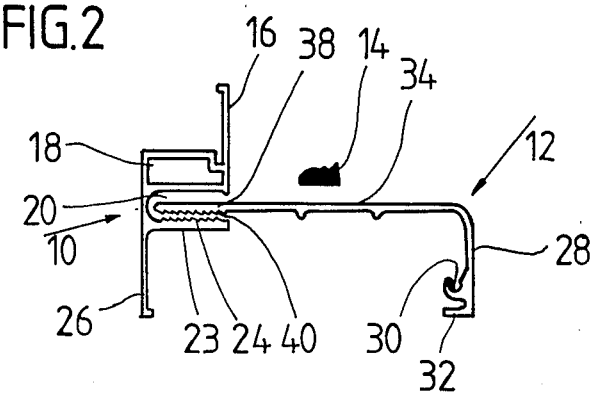
FIG. 2 a schematic side view of the components of FIG. 1 but with the inner tongue component inserted into the outer jaw component.
Figure 3:
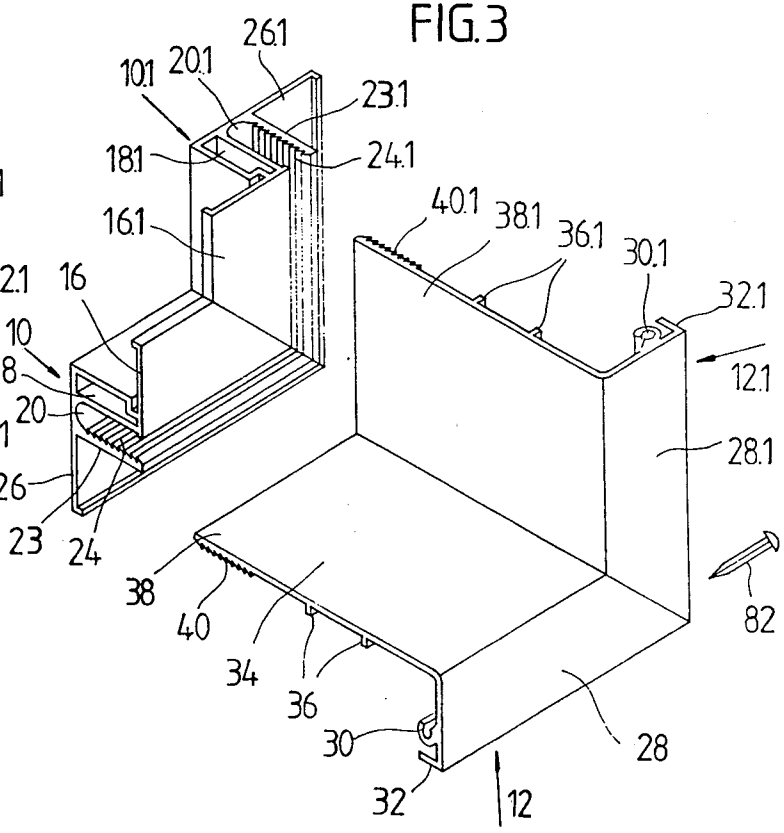
FIG. 3 an isomeric view corresponding to FIG. 2 but shown at a corner.

In FIGS. 2 and 3 the components are shown with the tongue 38 being inserted in the direction of arrow 46 into the recess 22 so that the teeth 40 are positioned above the teeth 24 of the jaw 20. As is clear from the drawings the opening gap of the jaw 20 is dimensioned such that the tongue 38 can be inserted or removed easily.

Figure 4:
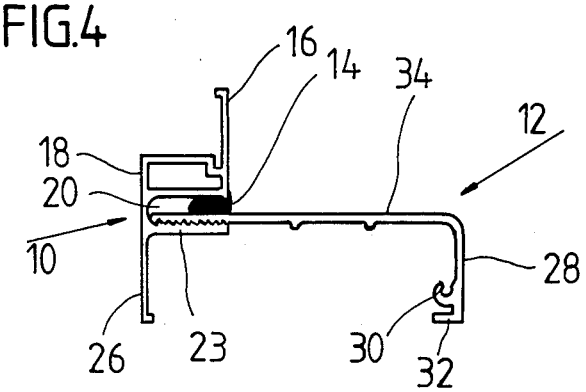
FIG. 4 a schematic side view of the components similar to FIG. 2 but with the plastics locking strip inserted into position in the recess to press the tongue component against one side of the jaw component.
Figure 5:
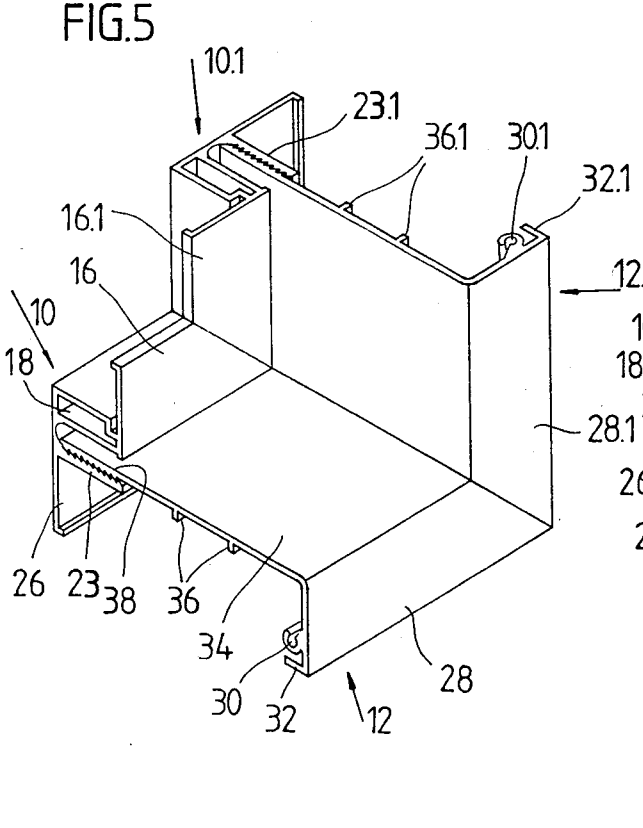
FIG. 5 an isomeric view corresponding to FIG. 4 but shown at a corner and without the plastics locking strip.

The teeth 40 and 24 are brought into positive locking engagement by inserting the locking strip 14 as shown in FIGS. 4 and 5. The strip 14 is pressed into the gap remaining between the upper surface of the tongue 38 and the upper inner edge of the jaw 20. Therewith the locking is such that the inner part 12 cannot be removed by pulling it out of the jaw 20 unless the locking strip 14 is first removed.

Figure 6:
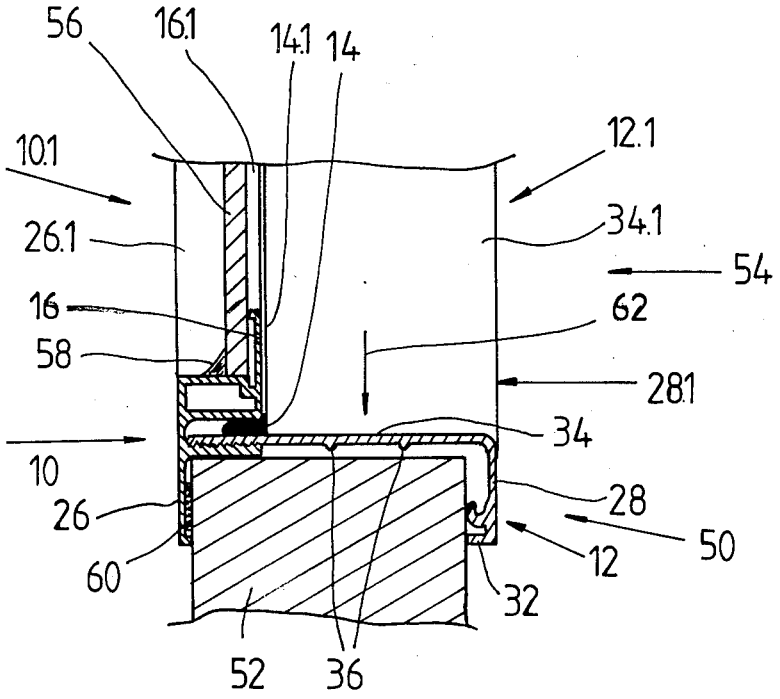
FIG. 6 a sectional side view of the bottom part of a window frame assembly in accordance with the invention and comprising the components illustrated in FIGS. 1 to 5 and fitted to a wall structure, the view being seen along arrows VI—VI in FIG. 7.

FIG. 6 shows a view similar to FIGS. 4 and 5 but being a sectional side view of a window frame assembly, generally indicated by reference numeral 48. However, the locking strip 14 is not shown.

In this view the bottom frame part 50 (being similar to the components illustrated in FIGS. 1 to 5) is shown fitted to a wall 52, and the vertical part 54 of the frame being fitted to the associated vertical wall part. The wall 52 may be a brick wall (plastered or untreated), or a timber panel wall or any other type of wall.

A glass pane 56 is held in position against the flanges 16, 16.1 etc. and is sealed and held to the outside by means of a sealing strip 58.

Between the flange 26 and the wall 52 a sealing strip 60 is provided.

The stops 36 prevent the webb 34 from being forced too far in the direction indicated by arrow 62.

Figure 7:
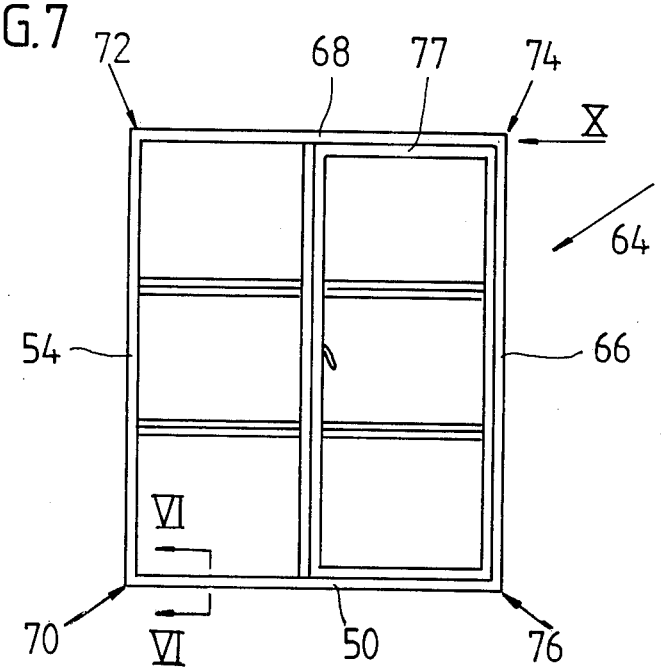
FIG. 7 on a reduced scale, a view from the outside on one type of window frame assembly, constructed of components illustrated in FIGS. 1 to 5.

Referring to FIG. 7 a full window frame 64 is illustrated, as seen from the outside of a building. The window frame 64 includes the bottom part 50, the vertical parts 54 and 66 and the upper head part 68 so that corners 70, 72, 74, 76 are formed. In the frame 64 a window sub-frame 77 is pivotally mounted against the vertical part 66 in conventional manner.

Figure 8:
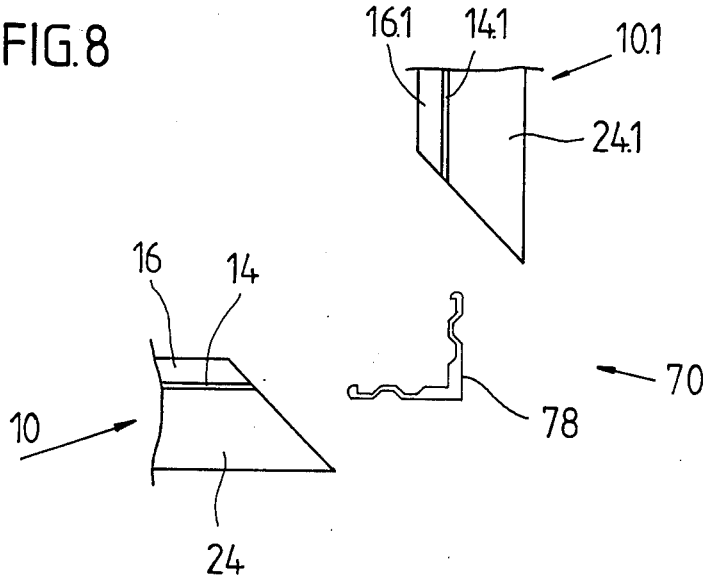
FIG. 8 on an increased scale, a side view of details of the corner parts of a window frame assembly and of a corner cleat.
Figure 9:
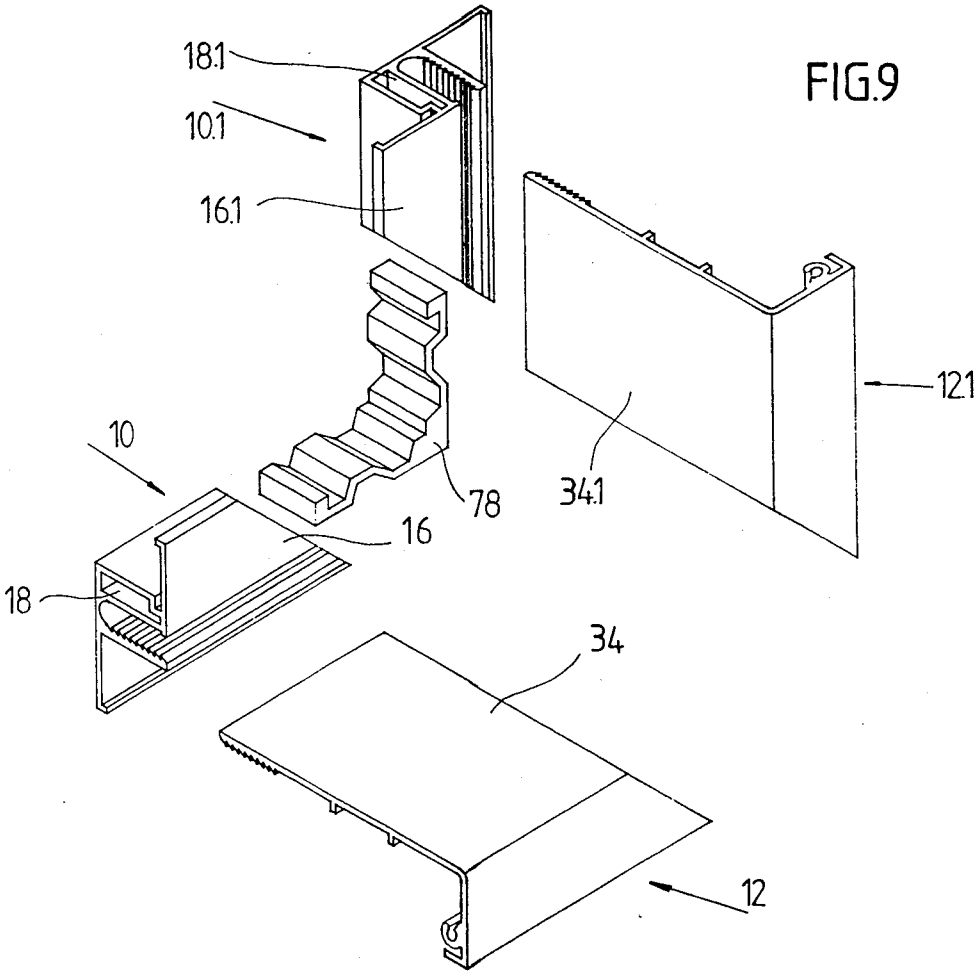
FIG. 9 an isomeric view of the parts illustrated in FIG. 8.

The corners 70, 72, 74, 76 are mintered and are held together by means of conventional cleat members. In FIGS. 8 and 9 a view on the corner 70 is shown. The cleat 78 is adapted to be inserted into the cleat recesses 18 and 18.1 of the vertical outer part 10.1 and the horizontal outer part 10. Thereafter the corner is crimped in conventional manner to join the parts together. The outer frame part therefore is preconstructed, even with the glazing 56 fitted in position.

Once totally assembled and fitted to an aperture in a wall, the window frame 64 illustrated in FIG. 7 is provided with removable screws or pins at its four corners to provide an additional locking together of the respective inner parts. This is illustrated for example in FIGS. 10 and 11, showing details of the corner 74 in FIG. 7.

Figure 11:
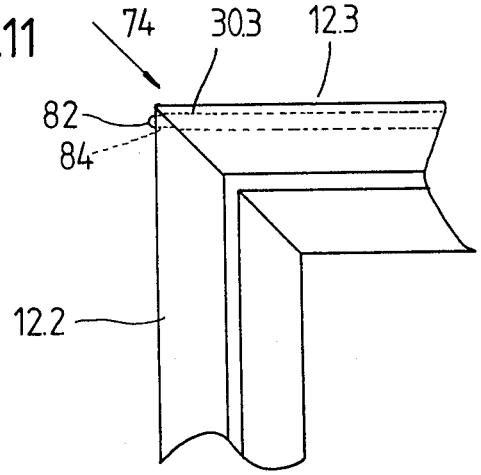
FIG. 11 a front view of the corner seen along arrow XI in FIG. 10.
Figure 10:
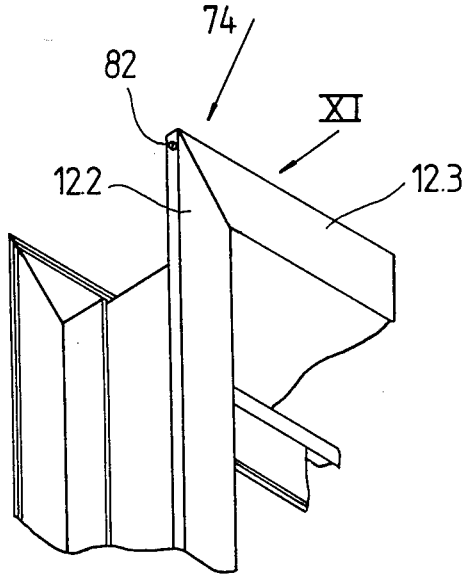
FIG. 10 an isomeric view of a corner of the frame assembly seen along arrow X in FIG. 7 and without details of the window sub-frame.

As is shown in FIGS. 10 and 11, a screw 82 (or a pin) is turned into the mitered corner of the head inner part 12.3 and vertical inner part 12.2 by passing through a hole 84 in the part 12.2 and screwing into the groove 30 (see also FIG. 1) of the part 12.3.

In practice, a window frame would be assembled with all its four outer parts 10, 10.1, 10.2, 10.4 joined together by cleats 78 as well as glazing and as illustrated in FIG. 6, whilst the four inner parts 12.1, 12.2 and 12.3 and locking strips 14 are kept apart. Thereafter a sealing strip 16 would be provided against the flange 26 of each of the outer parts 10, 10.1, 10.2, 10.3 as illustrated in FIG. 6. The outer frame comprising the assembled outer parts 10, 10.1, 10.2, 10.3 then is placed in position against the wall 52 surrounding an aperture in the wall. Whilst holding the outer frame in position, the inner parts 12, 12.1, 12.2, 12.3 (bottom, head top, and two vertical sides) are inserted into position as shown in FIGS. 2 and 3, so that the respective teeth 40 and 24 are adjacent each other. In doing so the four legs 28, 28.1, 28.2, 28.3 are pressed tightly against the inner surface of the wall, whilst the flanges 26, 26.2, 26.2, 26.3 are pressed tightly against the opposite outer surface of the wall. Thereupon the locking strips 14 (bottom, head top, and two vertical sides) are forced into the remaining gaps in the jaws 20 for causing a positive lock between the respective teeth 40, 24. In this position the legs 32, 32.1 of the inner parts 12, 12.1, 12.2, 12.3 will press against the inner surface of the wall 52. The window frame 64 thereby is firmly in position in the wall apererture and cannot be removed from the outside.

As a further measure to ensure good locking and to have a gapless joint, the screws 82 are screwed into the corners as explained with reference to FIGS. 10 and 11. These screws 82 may be replaced by pins.

Should it be necessary to remove the window frame 64, e.g. for reglazing or doing repair work on the wall or for re-use, the screws 82 are turned out, the strips 14 are pulled out and the four inner parts 12, 12.1, 12.2, 12.3 are lifted to cause the teeth 40 and 24 to disengage. Thereafter the inner parts 12, etc. are merely pulled out of the jaws 20. Then the outer frame, constituted by the assembled parts 10, 10.1, 10.2, 10.3, can be removed from the wall aperture.

By means of the arrangement in accordance with the invention, a fully glazed and painted window assembly can be plced into an aperture in a wall and can be fitted completely by attaching the inner parts, of which one constitutes a sill, namely part 12, without using any tools other than a screwdriver, and by means of unskilled persons in a relatively short period of time. In addition, the window frame assembly can be removed by using only a screw driver and without causing any damage to the window frame assembly or the wall aperture and can be re-used using the same components.

The frame construction in accordance with the invention does not require a sub-frame so as to obtain an exact size of the aperture in which it is to be fitted. It also can take up variations in the wall aperture size, both in vertical and in horizontal directions.

Once assembled an optical test (i.e. checking that the strips 14, and, if necessary, the screws 82, are in position) will confirm that the frame is firmly fitted.

I claim

1. A closure frame assembly, which includes an outer circumferential part receiving a panel member and having first abutment means abutting on the outer surface of a wall surrounding an aperture; a jaw component associated with the outer circumferential part and having an elongated recess; a first locking formation provided inside the elongated recess; an inner circumferential part having second abutment means abutting on the inner surface of a wall surrounding an aperture in a wall; a tongue component associated with the inner circumferential part and extending therefrom; a second locking formation provided at an extremity of the tongue component and being spaced away from the second abutment means, the first and second locking formations locking together when the second locking formation is located in the elongated recess of the jaw component and is pressed against the first locking formation; and a removable locking member inserted be into the recess for pressing the first and second locking formations firmly into locking contact.

2. An assembly as claimed in claim 1, in which the outer circumferential part comprises four individual elongated members joined together to form a rectangular outer frame.

3. An arrangement as claimed in claim 1, in which the inner circumferential part includes a number of individual elongated members, one of which constitutes an inner sill of a window frame.

4. An assembly as claimed in claim 1, in which the first locking formation includes teeth formations in the elongated recess, and the second locking formation includes associated teeth formations at the tongue component's extremity.

5. An assembly as claimed in claim 1, in which the locking member is a resilient elongated locking strip adapted to be fitted into the elongated recess for pressing the extremity of the tongue component towards the first locking formation in the elongated recess.

6. An assembly as claimed in claim 1, which is a window frame assembly.

7. An assembly as claimed in claims 1, which is a door frame assembly.

* * * * *